United States Patent [19]

Cognevich et al.

[11] Patent Number: 4,960,173

[45] Date of Patent: Oct. 2, 1990

[54] RELEASABLE WELL TOOL STABILIZER

[75] Inventors: Michael L. Cognevich, Tulsa; Steven H. Shirk, Broken Arrow, both of Okla.

[73] Assignee: Baker Hughes Incorporated, Houston, Tex.

[21] Appl. No.: 426,769

[22] Filed: Oct. 26, 1989

[51] Int. Cl.[5] ..... E21B 17/10

[52] U.S. Cl. ..... 166/241; 166/178; 166/214

[58] Field of Search ..... 166/117.5, 117.6, 214, 166/241, 250, 381, 386, 178, 338, 339, 340, 349, 301, 382, 123, 243, 206; 175/274, 276, 269, 325

[56] References Cited

U.S. PATENT DOCUMENTS

| | | | |
|---|---|---|---|
| 3,163,228 | 12/1964 | Hayes | 166/214 |
| 3,288,493 | 11/1966 | Brown | 166/214 |
| 4,811,792 | 3/1989 | Lembcke et al. | 166/381 |

*Primary Examiner*—Jerome W. Massie, IV

*Assistant Examiner*—Ezio Di Sante

*Attorney, Agent, or Firm*—Hubbard, Thurman, Turner, Tucker

[57] ABSTRACT

A mechanism for accurately positioning a well tool in axially concentric relationship to a well conduit comprises a housing having a plurality of stabilizer linkages mounted thereon with one end of each linkage being pivotally secured to the housing and the other end free to move in an axial direction. A compression spring engages a force transmitting connection to the other ends of the stabilizer linkages to bias same to a radially expanded position engaging the conduit wall. The connection between the compression spring and the stabilizer linkage includes two telescopically related sleeve elements which are secured together by a shear screw. In the event that the stabilizer linkage becomes stuck in the well, upward jarring movements of the housing will shear the shear screw and permit the stabilizer linkages to collapse radially inwardly and thus permit removal from the well.

3 Claims, 2 Drawing Sheets

RELEASABLE WELL TOOL STABILIZER

BACKGROUND OF THE INVENTION

1. FIELD OF THE INVENTION:

The invention relates to a mechanism for stabilizing a well tool in axially concentric relationship to the bore of a well conduit, and particularly to an arrangement for effecting the release of stabilizing elements from a radially expanded position in the event that the stabilizing elements become stuck in the well.

2. SUMMARY OF THE PRIOR ART:

So-called centralizers have long been employed in subterranean wells for positioning a well tool in concentric relationship to the bore of the well conduit. Normally, such stabilizers take the form of a plurality of peripherally spaced, radially outwardly extending leaf spring elements which frictionally engage the bore of the well conduit. With this type of construction, the centralizer necessarily must be in frictional engagement with the well conduit both during run-in and during retrieval of the tool from the well conduit. Such friction not only produces undesirable wear on the centralizer elements but also on the bore wall of the conduit. Moreover, the speed of run-in or withdrawal is necessarily detrimentally affected.

U.S. Pat. No. 4,811,792 discloses a centralizer mechanism comprising a plurality of expandable linkages mounted in a tubular body which can be part of a tubing string or constitute the bottom element of the tubing string. Such expansible linkages carry anti-friction elements, such as rollers, on their outer ends which are movable into engagement with the bore of a surrounding casing. The expandable linkages are normally held in a retracted position during insertion into the well by a shear pin, but are constantly biased to a radially expansible position by a compressed spring. The shear pin preferably comprises a fusible bolt which melts within a short time after running in of the tool string containing the stabilizer elements.

While this mechanism has been generally satisfactory, difficulties are encountered during retrieval of the tool string incorporating such a stabilizing mechanism. If the linkages or the rollers become stuck in the well, for any reason, retrieval of the tool string becomes very difficult. There is a need, therefore, for a stabilizing mechanism incorporating all of the advantages of the mechanism shown in U.S. Pat. No. 4,811,792, but permitting the convenient retrieval of the mechanism in the event that the stabilizing mechanism becomes stuck in the well.

SUMMARY OF THE INVENTION

The invention provides a stabilizing mechanism for a well tool comprising a tubular housing having a plurality of peripherally spaced, vertically extending slots formed in the wall thereof. A stabilizing linkage is mounted in each slot and one end of such linkage is pivotally secured in one end of the respective slot. The other end of each linkage is pivotally secured to an actuator assembly which is slidably and sealably mounted within the bore of the housing. The linkage is configured to produce a radially outward, concurrent expansion of two axially spaced pivot arms while the linkage is being expanded by axial movement of the actuator secured end of the linkage. Anti-friction means, preferably comprising axially spaced rollers, are mounted on the free ends of the aforementioned pivot arms and concurrently engage the bore wall of the well conduit into which the tool is inserted. The axial spacing of the rollers permits the stabilizing device to pass threaded joints and annular grooves in the bore wall of the conduit without substantially changing the axial position of the tool carrying the stabilizing device, since the axial spacing of the rollers permits only one roller to engage a groove or an inwardly projecting obstruction at a time.

To permit the ready insertion of the stabilizing tool and stabilizing device into the well conduit, a fusible bolt is provided for at least one stabilizing linkage which secures each linkage in a contracted position in the housing during run-in and for a short period after run-in, sufficient to permit the fusible bolt to reach a melting temperature below the higher ambient temperature of the well at the depth to which the tool is inserted. Thus, there is no frictional engagement between the stabilizing device and the bore wall of the conduit during run-in. Upon melting of the fusible bolt, the stabilizing linkages move radially outwardly to engage the conduit wall under the axial bias of a compressed spring operating on the axially movable sleeve. To prevent an impact engagement of the stabilizing rollers with the bore wall of the conduit, a sleeve on the actuator assembly cooperates with the bore wall of the housing to define a trapped fluid chamber which prevents rapid axial movement of the sleeve in the linkage expansion direction. The rate of axial movement of the sleeve is controlled by an orifice passage permitting the discharge of fluid from the fluid trapping chamber to a second chamber at a controlled rate.

When it is necessary to remove the tool from the well, it is, of course, desirable that the stabilizer device rapidly adjust itself in a radial direction to accommodate passage of the bore wall engaging rollers through internal restrictions found in the bore wall of a well conduit. Rapid radial movement of the stabilizing linkages in an inward direction is permitted by a check valve in the second chamber receiving fluid from the trapped fluid chamber to permit the rapid transfer of fluid which accumulated in the second chamber during the radially outward movement of the stabilizing linkages to the trapping chamber. Thus, the stabilizing linkages can be readily deflected in an inward direction to accommodate passage over internal conduit wall obstructions.

To permit the release of the stabilizing mechanism from the well if, for any reason, any portion of such mechanism becomes stuck in the well and/or the check valve fails to function, this invention provides a shearably connected force transmitting assembly between the compressed spring and the axially movable ends of the stabilizing linkages. Such force transmitting mechanism preferably comprises a tubular unit having one end thereof abutting the compressed spring and the other end telescopically related to a sleeve to which the movable ends of the linkages are pivotally secured. One or more shear screws are then provided between the telescoped portions of the tubular unit and the sleeve.

Accordingly, the normal operation of the apparatus during insertion and retrieval is the same as described in the aforementioned patent #4,811,792. However, if for any reason, the rollers or any other portion of the stabilizing linkages becomes stuck in the well, the application of a predetermined upward force to the tubing string in which the stabilizer mechanism is inserted, will effect the shearing of the connection between the tubular unit and the sleeve unit, thus permitting the stabilizer units to readily retract to a radially inward position in which the entire stabilizing mechanism can readily pass through whatever obstruction was preventing their upward travel.

Other advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
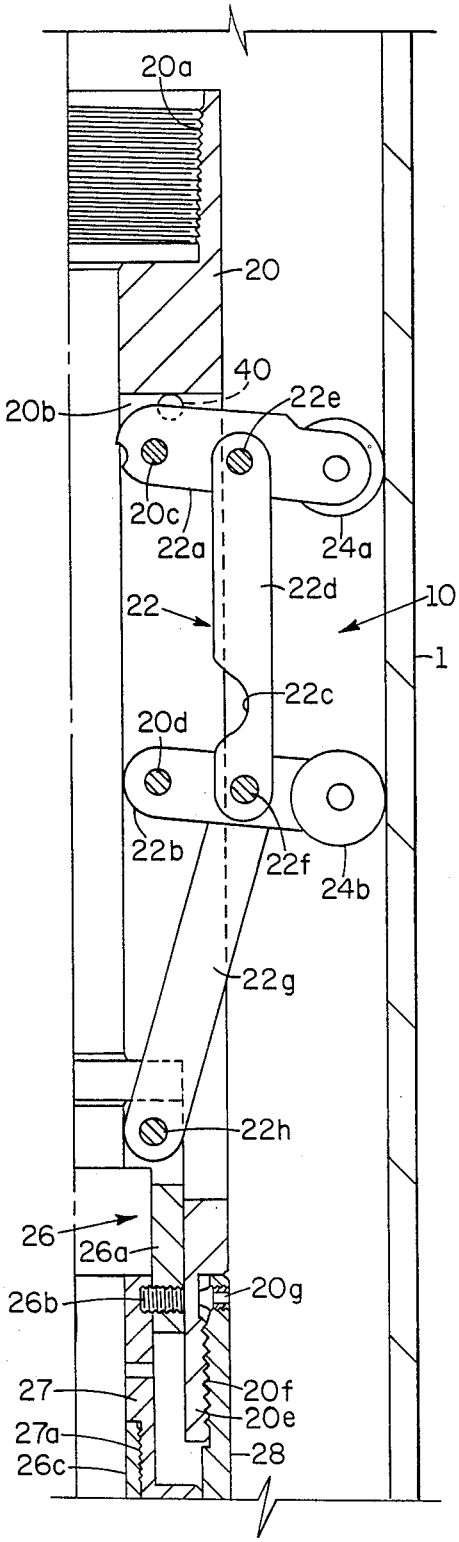
FIGS. 1A and 1B collectively constitute a vertical quarter sectional view of a stabilizing device embodying this invention with the stabilizing elements of the device shown in their radially expanded, casing engaging positions
Figure 1B:
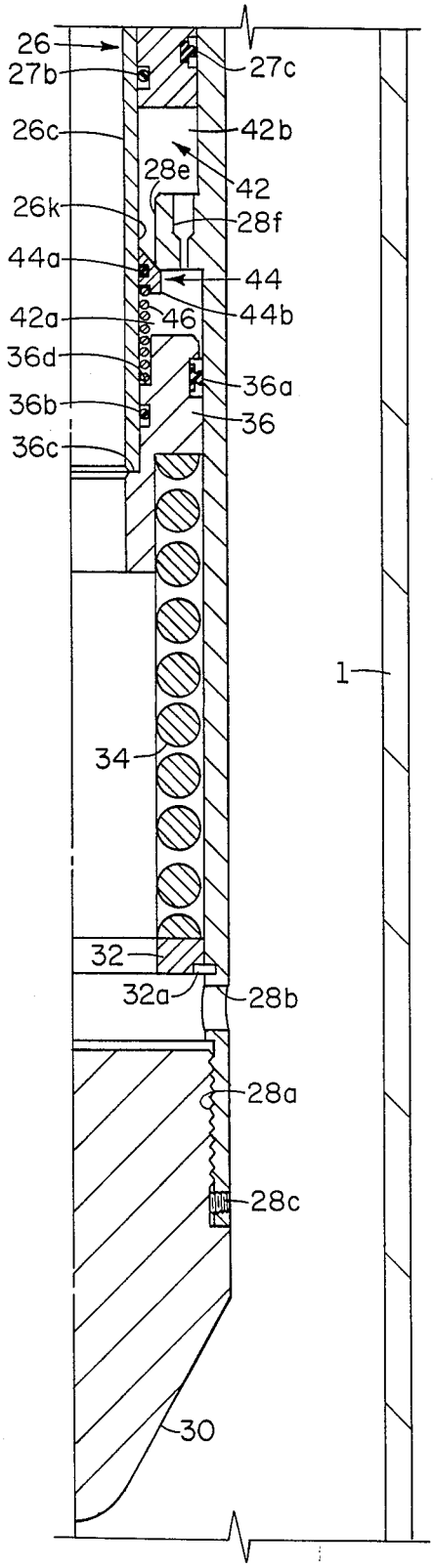

Referring to Figs. 1A and 1B, a stabilizing mechanism 10 embodying this invention is shown in radially expanded position relative to a well conduit 1, which normally is a well casing. Stabilizing mechanism 10 comprises a tubular housing 20 which is provided at its upper end with internal threads **20*a* for engagement with the bottom of a tool string. Housing 20 is further provided with a plurality of peripherally spaced, vertically extending slots 20*b*. Each slot receives a radially expandable linkage 22 comprising a pair of pivot arms 22*a* and 22*b* which are respectively pivotally mounted in the slots 20*b* by transverse pivot pins 20*c* and 20*d***.

The medial portions of the pivot arms **22*a* and 22*b* are pivotally interconnected by a longitudinally extending link 22*d* which is secured to the pivot arms 22*a* and 22*b* by pivot pins 22*e* and 22*f*. The free ends of the links 22*a* and 22*b* respectively mount anti-friction devices, such as rollers 24*a* and 24*b***.

An expansion link **22*g* is also secured at one end to the pivot pin 22*f* and the other end is pivotally secured to an axially shiftable force transmitting assemblage 26 by a pivot pin 22*h*. Accordingly, when the force transmitting assemblage 26 is disposed in a downward position relative to the radially expansible linkages 22, the linkages 22 are retracted to the position shown in FIG. 2A wherein all of the components of the linkage lie within the periphery of the housing 20, and thus offer no opportunity for damaging contact with the conduit or casing wall as the stabilizer unit 10 is run into the well. A notch 22*c* in each link 22*d* clears pivot pin 20*d*** in this position.

Each stabilizer linkage 22 is radially expanded to engage the rollers **24*a* and 24*b* with the bore wall of the casing 1 by upward movement of the force transmitting assemblage 26. Such force transmitting assemblage comprises an upper sleeve 26*a* lower end by one or more shear screws 26*b* to an intermediate sleeve element 27. Sleeve element 27 is secured by threads 27*a* to an extension tube 26*c* which extends downwardly and abuts against an upwardly facing internal shoulder 36*c* provided on an annular spring anchor 36. An inner sleeve 28 is threadably secured by external threads 20*f* to the lower end portion 20*e* of the housing 20. Such threads are secured by a set screw 20*g***.

The inner sleeve 28 cooperates with the extension sleeve **26*c* to define an annular chamber 42 within which the lower portion of the lower sleeve element 27 is sealably mounted by seals 27*b* and 27*c*. A plurality of peripherally spaced ports 28*b* are provided in the bottom end of extension sleeve 28 to permit well fluids to freely enter the interior of the extension sleeve 28 and hence the bore of the housing 20**.

The bottom end of the extension sleeve 28 is provided with internal threads **28*a* for the mounting thereto of a lower portion of the particular tool string in which the stabilizer mechanism 10 is to be incorporated or, in this case where the stabilizer mechanism is at the bottom of the tool string, a flow deflector 30 may be inserted and secured to the bottom of the extension sleeve 28 by threads 28*a* and set screw 28*c***.

A spring anchor ring 32 is secured adjacent to the bottom end of extension sleeve 28 by a snap ring **32*a* to provide a seat for an actuator spring 34. The top of actuator spring 34 engages an annular spring seat 36 which has a seal 36*b* engaging the lower end of the actuating sleeve extension 26*c*. As mentioned, the bottom end of actuating sleeve extension 26*c* abuts an upwardly facing shoulder 36*c* provided on the annular spring seat 36. Spring seat 36 is slidably and sealably mounted within the annulus 42 by an outer seal 36*a* and an inner seal 36*b*. Thus, when no restraints are imposed upon upward movement of the force transmitting mechanism 26, the spring 34 moves the force transmitting assemblage 26 upwardly causing the radially expansible stabilizer linkages 22 to move outwardly to the position shown in Fig. 1A where the anti-friction rollers 24*a* and 24*b*** are in engagement with the bore wall of the well conduit.

To maintain the radially expansible stabilizer linkages 22 in a contracted position during run-in, fusible bolts 40 (shown only in dotted lines) abuts one of the links incorporated in one of the expansible linkages 22 and effectively secures all linkages 22 within the body of the housing 20. For example, fusible bolts 40 are shown as abutting pivot arm **22*a*. The melting point of fusible bolts 40 is selected to produce melting within a reasonable time, say ten to thirty minutes, after the fusible bolts are exposed to the ambient well temperatures existing at the location of the stabilizer mechanism 10 in the well. Thus, during the entire run-in of the stabilizer mechanism 10, the linkages 22 are in their retracted positions and do not move into engagement with the bore wall of the casing 1 until the fusible bolts 40** have melted by exposure to the downhole well temperatures.

To prevent the expansible linkages 22 from rapidly expanding into engagement with the bore wall of the well conduit and thus possibly damaging the anti-friction roller elements **24*a* and 24*b*, the annulus 42 between the sleeve extensions 26*c* and 28 is utilized to define a dash pot chamber immediately above the spring seat 36. An internally projecting rib 28*e* is formed on extension sleeve 28 and lies within the dash pot chamber 42. The dash pot chamber 42 is filled with an appropriate fluid through a plug fill port (not shown) formed in the internally projecting rib 28*e***.

A check valve 44 is provided comprising a ring **44*b* mounting an O-ring 44*a* which is urged into sealing engagement between the lower end of the annular rib 28*e* and the adjacent external surface 26*k* of the actuating sleeve extension 26*c* by a light spring 46. Spring 46** abuts an upwardly facing internal shoulder 36*d* provided on the upper spring seat 36.

It will therefore be apparent that the dash pot chamber 42 in reality comprises two vertically spaced chambers 42*a* and 42*b* separated by the annular rib 28*e* and the check valve 44. A constricted orifice passage 28*f* is formed in the annular rib 28*e* to permit fluid to flow at a controlled rate from the lower chamber 42*a* into the upper chamber 42*b*. Thus the upward movement of the force transmitting assemblage 26, and hence the radial expansion of the stabilizer linkage 22, will be controlled in accordance with the rate of fluid flow through the orifice passage 28*f*.

On the other hand, when the tool string is withdrawn from the well, it is quite common for the anti-friction rollers 24*a* and 24*b* to contact internal ribs or other constrictions or obstructions formed on the bore wall of the well conduit. The anti-friction rollers 24*a* and 24*b* must be capable of rapid contraction movement in order to pass such obstructions without damage. This accomplished by the check valve 44. When either anti-friction roller 24*a* or 24*b* encounters an obstruction, a downward force is applied to the force transmitting mechanism 26. Such downward force will cause a compression of the trapped fluid contained in the upper chamber 42*b* and the increased fluid pressure in such chamber will cause the check valve 44 to open to permit rapid fluid flow into lower chamber 42*a* and permit free downward movement of the force transmitting mechanism 26, hence permitting free contacting movement of the stabilizer linkages 22.

The rollers 24*a* and 24*b* thus function to firmly and accurately hold the stabilizer housing in alignment with the axis of the well conduit, hence providing a centralizing action for the tubing string in which the stabilizer mechanism 10 is incorporated.

Figure 2A:
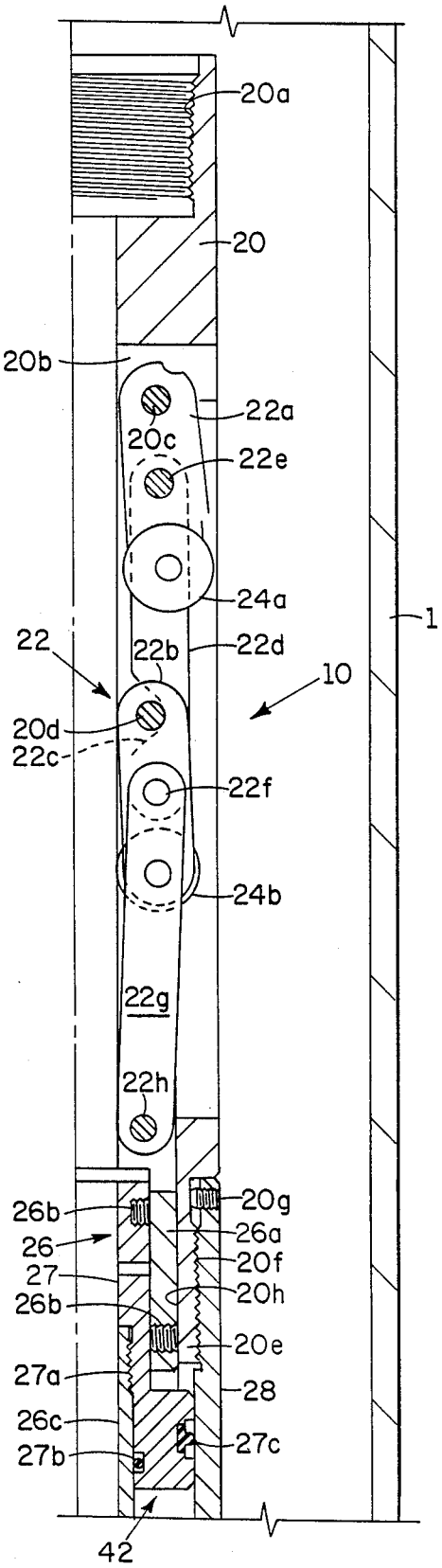
FIGS. 2A and 2B are views similar to FIGS. 1A and 1B but showing the components of the stabilizing device in a radially retracted position produced through the application of an upward force to the stabilizing mechanism.
Figure 2B:
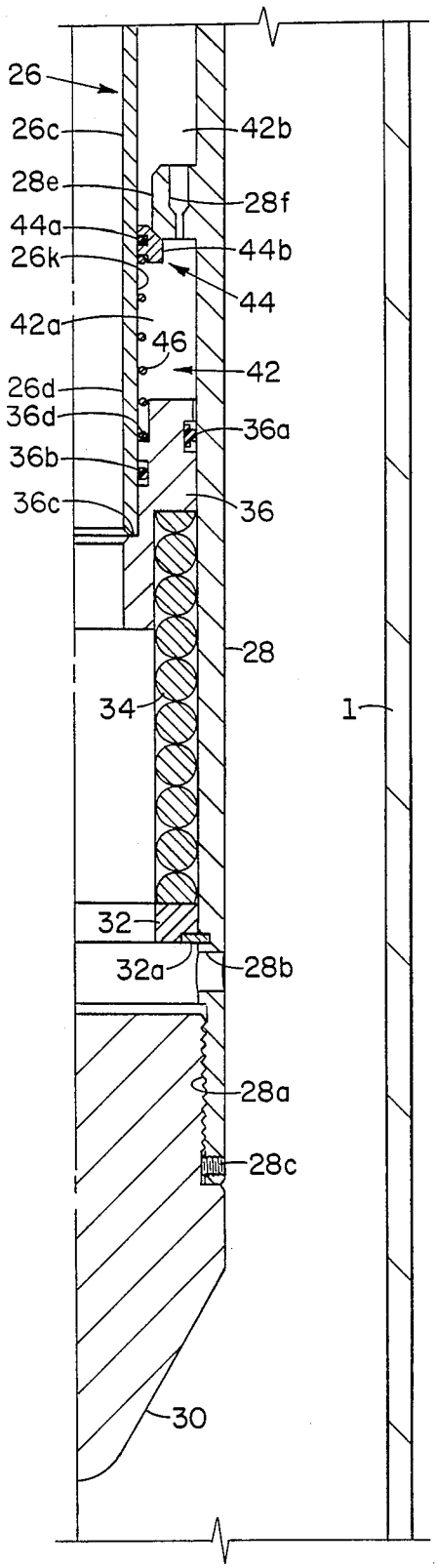

Despite the provisions for permitting the collapse of the stabilizing linkages 22 when encountering an obstruction through the opening of the check valve 44*a*, it sometimes happens that the check valve 44*a* will not function and thus the stabilizing linkages 22 become stuck in the well. The stabilizing linkage 22 may also become stuck in the well for a number of other reasons, such as an accumulation of particulars within or between the operating components, deviations in the well bore configuration. Regardless of the cause, the stabilizing units may be released from such stuck condition through the application of upward jarring forces to the tubing string in which the stabilizing mechanism 10 is incorporated. Such upward forces produce an upwardly directed shearing force on the shear pins 26*b* and effect the separation of the upper sleeve 26*a* of the force transmitting assemblage 26 from the lower sleeve 27. Thus, as illustrated in FIG. 2A, the upper force transmitting sleeve 26*a* can move downwardly relative to the tubular body 20 and permit the stabilizing linkages 22 to assume a retracted position. This ability to effect the retraction of the stabilizing linkages when an obstruction is encountered and the normal releasing apparatus does not function is obviously a desirable adjunct to this tool.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters patent is:

1. A stabilizer housing for a well tool mounted in a cased subterranean well comprising, in combination:

a tubular body connectable in co-axially aligned series relationship to the well tool;

spaced, longitudinal slots extending through the wall of said tubular body, with an upper and a lower end;

a radially expandable linkage disposed in each said longitudinal slot;

means for pivotally securing one end of each said linkage in one end of the respective longitudinal slot, whereby axial movement of the other end of each said linkage relative to said tubular body shifts said linkage from a radially contracted run-in position to a radially expanded position;

anti-friction means carried by each said linkage engagable with the well casing in said radially expanded position;

a compressed spring mounted in the other end of said tubular body;

a force transmitting assemblage interconnecting said spring and said lower ends of said linkages, thereby urging said linkages to said radially expanded positions;

said force transmitting assemblage comprising two releasably connected members separable in response to a predetermined upward force applied to said tubular body when said expanded linkages become stuck in the well.

2. The apparatus of claim 1 wherein said force transmitting assemblage comprises a tubular unit abutting said compressed spring;

a sleeve secured to said other ends of said linkages; and shearable means interconnecting said tubular unit and said sleeve.

3. The apparatus of claim 2 wherein said tubular unit and said sleeve are telescopically related.

* * * * *